US005694853A

United States Patent [19]

Stempien

[11] Patent Number: 5,694,853

[45] Date of Patent: Dec. 9, 1997

[54] ALIGNMENT METHOD FOR ACCURATELY REGISTERING SHEET MATERIAL ON A PLATE AND FIXTURE THEREFOR

[75] Inventor: Joseph W. Stempien, Newington, Conn.

[73] Assignee: Gerber Scientific Products, Inc., Manchester, Conn.

[21] Appl. No.: 694,205

[22] Filed: Aug. 8, 1996

[51] Int. Cl.[6] ..... B41B 1/00; B41F 1/34

[52] U.S. Cl. ..... 101/401.1; 101/485; 101/DIG. 36

[58] Field of Search ..... 101/485, 486, 101/401.1

[56] References Cited

U.S. PATENT DOCUMENTS

| | | | |
|---|---|---|---|
| 3,028,786 | 4/1962 | Wanielista et al. | 101/DIG. 36 |
| 3,264,106 | 8/1966 | Alldis | 101/DIG. 36 |
| 3,451,337 | 6/1969 | Updegraff | 101/401.1 |
| 3,605,622 | 9/1971 | Zarip | 101/485 |
| 3,613,252 | 10/1971 | Moos | 101/DIG. 36 |
| 3,943,851 | 3/1976 | Inada et al. | 101/DIG. 36 |
| 4,485,447 | 11/1984 | Ericsson | 101/DIG. 36 |
| 5,537,927 | 7/1996 | Rogovein et al. | 101/485 |
| 5,560,297 | 10/1996 | Ford | 101/401.1 |

*Primary Examiner*—Eugene H. Eickholt
*Attorney, Agent, or Firm*—McCormick, Paulding & Huber

[57] ABSTRACT

A method for aligning sheet material having a computer generated image thereon with a precut plate stock so that the image is disposed in a predetermined position the plate stock utilizes an alignment fixture. The fixture has registration guides which are matched with indicia on the sheet material to establish the position of the sheet material, and the rigid plate stock is the placed underneath the sheet material on the fixture in a known positional relationship with the guides. The sheet material and the plate stock are then joined together by adhesives or other means without disturbing the established positional relationship of the sheet material relative to the plate stock.

28 Claims, 4 Drawing Sheets

ALIGNMENT METHOD FOR ACCURATELY REGISTERING SHEET MATERIAL ON A PLATE AND FIXTURE THEREFOR

BACKGROUND OF THE INVENTION

The present invention relates to a method for aligning sheet material having an image thereon with a plate so that the image is disposed in a predetermined location on the plate when the sheet material and plate are joined. The invention also relates to an alignment fixture for carrying out the method.

New techniques for printing images on flexible sheet material with computer controlled printers have significantly expanded the printing field. Additionally the cutting of plate stock by means of computer controlled cutters and routers for making signs has also expanded. It has been suggested that the printing and cutting technologies can be merged to more completely automate the sign making process. One example of a merger of the printing and cutting art is given in U.S. Pat. No. 5,537,135 where the printing and cutting operations are carried out on a single workpiece in the form of flexible sheet material.

A further merger of the printing and cutting technologies arises when the flexible material bearing a printed image is to be applied to a rigid plate stock as a backing material for a sign, nameplate or other graphic product. Such a product results when the flexible material is joined by adhesives or other bonding techniques to a plate stock to form a laminated structure. When the printing and cutting operations are carried out on the respective elements prior to joining the elements in a laminated structure, one problem that must be addressed is how the two elements are brought together in a precise registration so that the printed image is centered or otherwise located in a predetermined position on the plate in the finished product.

It is accordingly a general object of the present invention to provide a method for accurately registering a flexible sheet material bearing a graphic image on a rigid plate stock to form a laminated structure. It is a further object of the present invention to provide an alignment fixture on which the flexible sheet material and plate stock can be joined in precise registration with one another.

SUMMARY OF THE INVENTION

The present invention in one aspect resides in an alignment method for accurately registering a flexible sheet material bearing a graphic image on a rigid plate stock.

The method includes the steps of providing registration indicia on a flexible sheet material such that the indicia identify two orthogonal reference axes and an origin point for each axis. A printer is then provided with means for printing a graphic image on the flexible material in predetermined relationship with the registration indicia.

A registration fixture is then provided with registration guides which identify two orthogonal axes and an origin point for each axis which mate with the registration indicia of the flexible sheet material. The sheet material is then positioned on the fixture with the orthogonal axes and origin points of the material and the guides in fixed relationship with one another. A rigid plate stock is then placed on the registration fixture with the edges of the plate stock in positional relationship with the registration guides whereby the rigid plate stock and the sheet material are in a known positional relationship with each other. The flexible sheet material and the rigid plate stock can then be secured to one another while on the registration fixture whereby the graphic image printed on the flexible sheet material by the printer and the rigid plate stock are in known registration.

Another aspect the invention relates to an alignment fixture for accurately positioning the sheet material bearing an image in registration with a plate stock. The fixture includes a planar base defining a support surface for the sheet material and the stock. Registration and holding means are connected to the planar base for holding the sheet material in a predetermined position relative to the support surface. Fence means are also connected to the planar base for positioning plate stock in a predetermined position on the support surface in underlying relationship with the sheet material bearing the image. In this fashion the fence means and the registration and holding means are connected to the base in relationship to one another so as to also position the sheet material and plate stock in predetermined relationship with one another for joining in a laminated structure.

The registration and holding means can take several different forms including alignment pins that are mounted to the planar base or clamping means and registration indicia connected with the base.

The present invention in its various embodiments permits a flexible sheet material bearing an image to be joined to a plate stock with the image in a predetermined position relative to the stock. The method can be carried out in conjunction with the fixture without iteration to produce a laminated product precisely arranged in a predetermined relationship.

DESCRIPTION OF THE PREFERRED EMBODIMENTS

Figure 1:
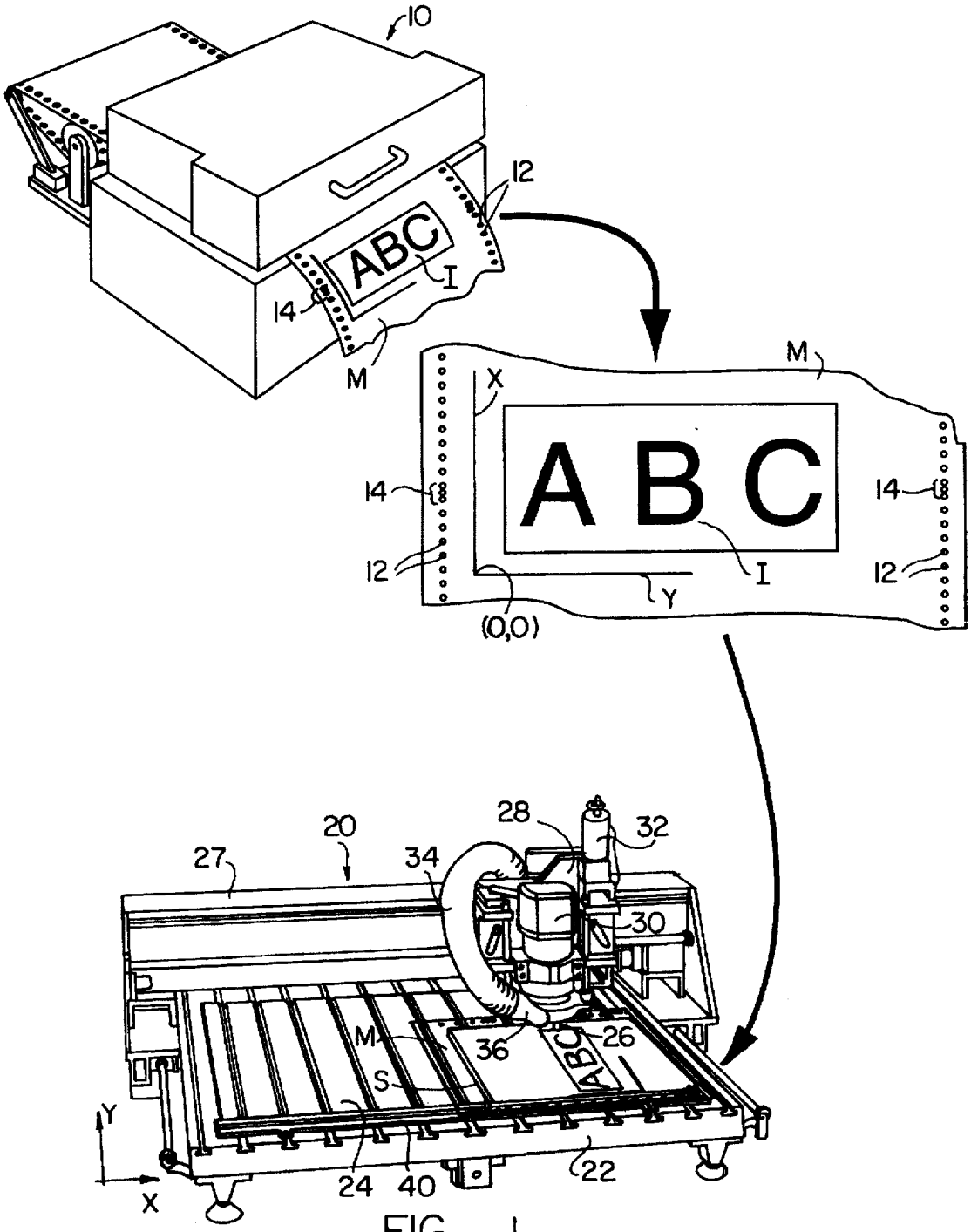
FIG. 1 is a flow diagram of the method and shows the progression of flexible sheet material from a printer, where the material receives an image, to a cutting machine including a fixture for placing the material in registration with the plate stock.

FIG. 1 shows diagramatically the process for making a sign, nameplate or other graphic product composed of a flexible sheet material M bearing a printed image and a plate stock S which are brought in to alignment with one another to form a laminated structure. The flexible sheet material may be any one of a variety of products such as paper, metal, or plastic. In the realm of plastics the material may be an acrylic, a polyester, a polypropylene fused to a polyester or a polycarbonate. One preferred material is a coated polycarbonate sold under the tradename "LEXEdge" by Gerber Scientific Products of Manchester, Conn.

A graphic image I is printed on the sheet material M by means of a thermal printer 10. One example of a thermal printer which is suitable for this purpose is disclosed in U.S. Pat. No. 5,537,135 which has a microprocessor control and receives graphic data in digital form for operating the printer and producing the image I in a predetermined position on the strip of sheet material M. As shown the sheet material has a row of perforations or drive holes 12 along each longitudinal edge which are engaged by drive sprockets to move the material through the printer relative to a thermal printhead during the printing operation. The image I, therefore, is disposed on the material M in predetermined relationship with the drive holes because of the controlled movement of the strip by the image data and the printer controls. In one embodiment, the drive holes 12 have a unique pattern or group 14 of three closely spaced holes which ensure proper threading of the material at each edge in the printer, and additionally serve as the reference or origin point from which each printing operation begins. Consequently, the origin point (0,0) in the two coordinate directions of the image is in a predetermined location with respect to the group of holes 14. It should be understood that the group of three drive holes is normally repeated at intervals along the strip of sheet material M in order to engage a corresponding set of sprocket teeth in the printer, but the one of the groups 14 which is closest to the origin point will be obvious from the image.

For reference purposes the coordinate axes X,Y are also printed on the sheet material M at the origin point. These axes are useful in identifying the origin and orienting the sheet material relative to the plate stock to which the image is to be laminated as described further below. Since the axes X,Y and the image are generated by the same printer (10), the axes are precisely referenced to the image and serve as an accurate identification of the origin point.

In order to produce a laminated product in which the sheet material M with the image I forms one laminate and a plate stock S cut to conform to the image forms the other laminate, the sheet material M is placed in an alignment fixture in the cutting machine 20. The cutting machine can take a number of forms but one embodiment of the invention the cutting machine is a processor-controlled router such as disclosed in U.S. Pat. No. 4,822,219, a commercial embodiment of which is known as the Dimension 200 sold by Gerber Scientific Products of Manchester, Conn. Although the plate stock is pre-cut with straight edges which serve as references for registration of the sheet material, the cutting machine can be used to impose finish cuts on the product, such as bevels along the edge of the product and routed grooves in the product, or to sever the plate stock into smaller pieces with individual images from the sheet material M on each piece.

The cutting machine 20 includes a worktable 22 having a support surface 24 on which workpieces are held while they are cut by a routing tool 26. The tool is suspended over the worktable 22 from an X-carriage 27 that moves back and forth over the table in the illustrated X-coordinate direction, and a Y-carriage 28 that is mounted on the X-carriage and moves back and forth over the table in the illustrated Y coordinate direction. The tool is driven rotatably by a drive motor 30, and is lowered and raised in and out engagement with workpieces on the table by means of a lift motor 32. A vacuum hose 34 connected at one end to a vacuum pump and at the other end with a manifold 36 surrounding the tool 26 is used to remove chips resulting from the cutting operation.

Figure 2:
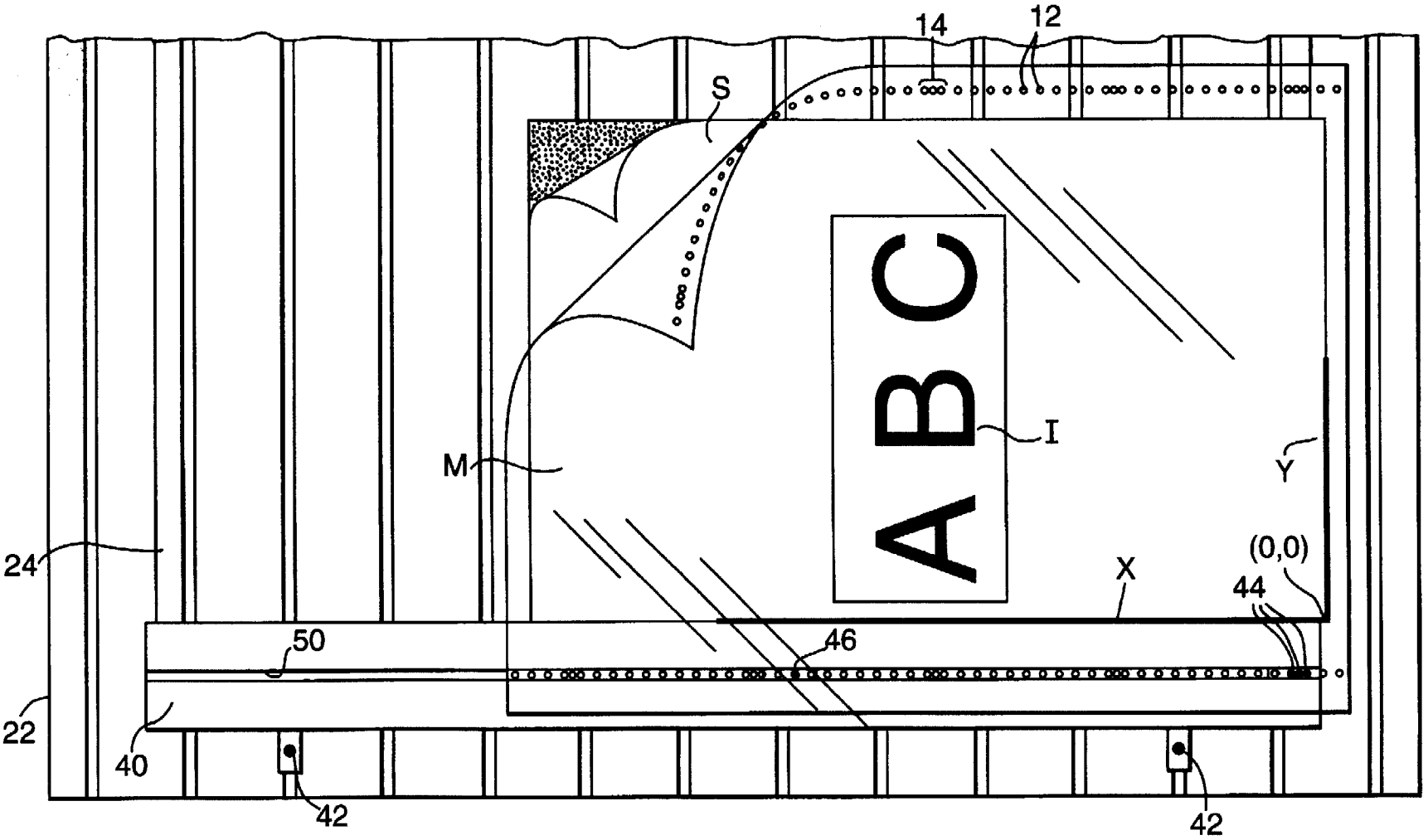
FIG. 2 is a plan view showing the method of registering the sheet material with the plate stock in the fixture.
Figure 3:
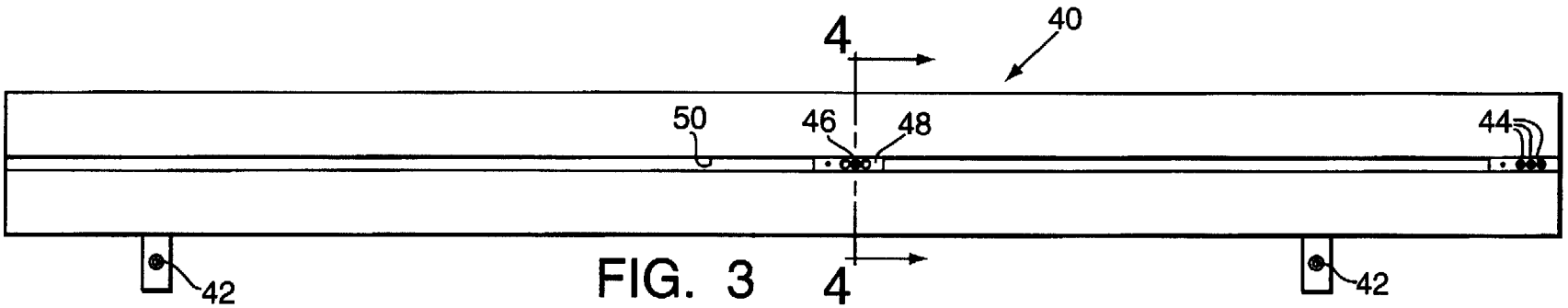
FIG. 3 is a plan view showing a portion of the fixture in FIG. 2.
Figure 4:
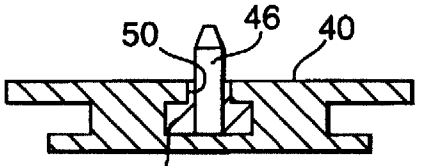
FIG. 4 is a cross-sectional view of the fixture as seen along the sectioning line of 4—4 of FIG. 3.

FIGS. 2, 3, and 4 show in greater detail the alignment fixture for holding the sheet material M and a plate stock S in registration in the cutting machine 20. The fixture includes an elongated bar 40 which is secured to the worktable 22 by means of bolts 42. The bolts engage clamp nuts which are slidable in T-grooves in the surface of the worktable 22 so that the bar 40 can be adjusted for precise alignment with the Y-coordinate axis of the cutting machine 20.

As shown more specifically in FIGS. 3 and 4, three grouped alignment pins 44 are fixed in the bar at one end, and another pin 46 is mounted in a T-shaped slide block 48 within a T-shaped groove 50 in the bar. The groove 50 extends parallel to the longitudinal edges of the bar and, thus, the pin 46 is movable relative to the group of fixed pins 44 at the one end of the bar. The pins 44 are arranged in precisely the same pattern as the group of drive holes 14 in the sheet material M, and the pins 44 and 46 have precisely the same size as the drive holes to engage and hold the sheet material M. Additionally the slide block 48 is mounted to be flush with the upper surface of the alignment bar 40.

Accordingly, the sheet material M can be mounted on the bar 40 with the patterned holes 14 engaged with the pins 44, and another hole 12 near the opposite end of the strip engaged with the pin 46 as shown in FIG. 2. The pin 46 is slidable back and forth along the bar in order to accommodate segments of the sheet material of different lengths.

By appropriate adjustment of the alignment bar 40 on the worktable 22, the X and Y axes of the image on the sheet material M engaged with the bar can be precisely aligned with the X and Y axes respectively of the cutting machine 20. The adjustment is made as stated above with the bolts 42 shown in FIG. 2. Various means for identifying the axes of the cutting machine may be employed. In one such machine the axes may be determined from the edges of the worktable 22, but other structures such as the carriage ways and table grids may alternatively be employed.

To make most effective use of the plate stock S, the stock should be aligned or registered with the image or axes of the image when the sheet material M is secured to the worktable 22 by means of the alignment bar 40. Thus, the positioning of the sheet material M in registration with the stock material S employs an alignment fixture that includes both the alignment bar 40 and the worktable 22 as a base for the fixture. Such positioning of the plate stock, if it is a rectangular piece, can employ fences on the table, the alignment bar 40 or the X and Y axes on the sheet material in overlying relationship with the plate stock. The stock must additionally be held in position on the worktable 22 by means of clamps, adhesive or other means before the sheet material is attached as a laminate to the plate stock.

One method of attaching the sheet material M to the stock S after the pieces are brought into registration as shown in FIG. 2 employs a pressure sensitive adhesive on the upper surface of the stock and a protective film that overlays the adhesive and prevents the sheet material M from attaching to the stock before they are brought into precise registration with one another. Once they-are in registration the flexible sheet material M is lifted back as illustrated at one corner in FIG. 2, and the protective film on the plate stock S is stripped away to expose the underlying adhesive. The sheet material, firmly engaged with the alignment pins 44 and 46, is then laid back down on top of the stock, and pressed against the adhesive to form the laminated structure. The structure can then be cut by means of the routing tool 26 using the origin (0,0) of the X and Y axes as a reference for the material M as well as for the plate stock S.

Multiple images may be printed on the material M at the same time and may thereafter be separated from one another on individual pieces of plate stock by the operation of the cutting machine 20.

Figure 6:
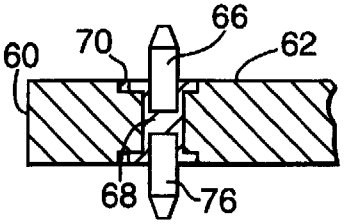
FIG. 6 is a cross-sectional view of the fixture as seen along the sectioning line 6—6 in FIG. 5.
Figure 5:
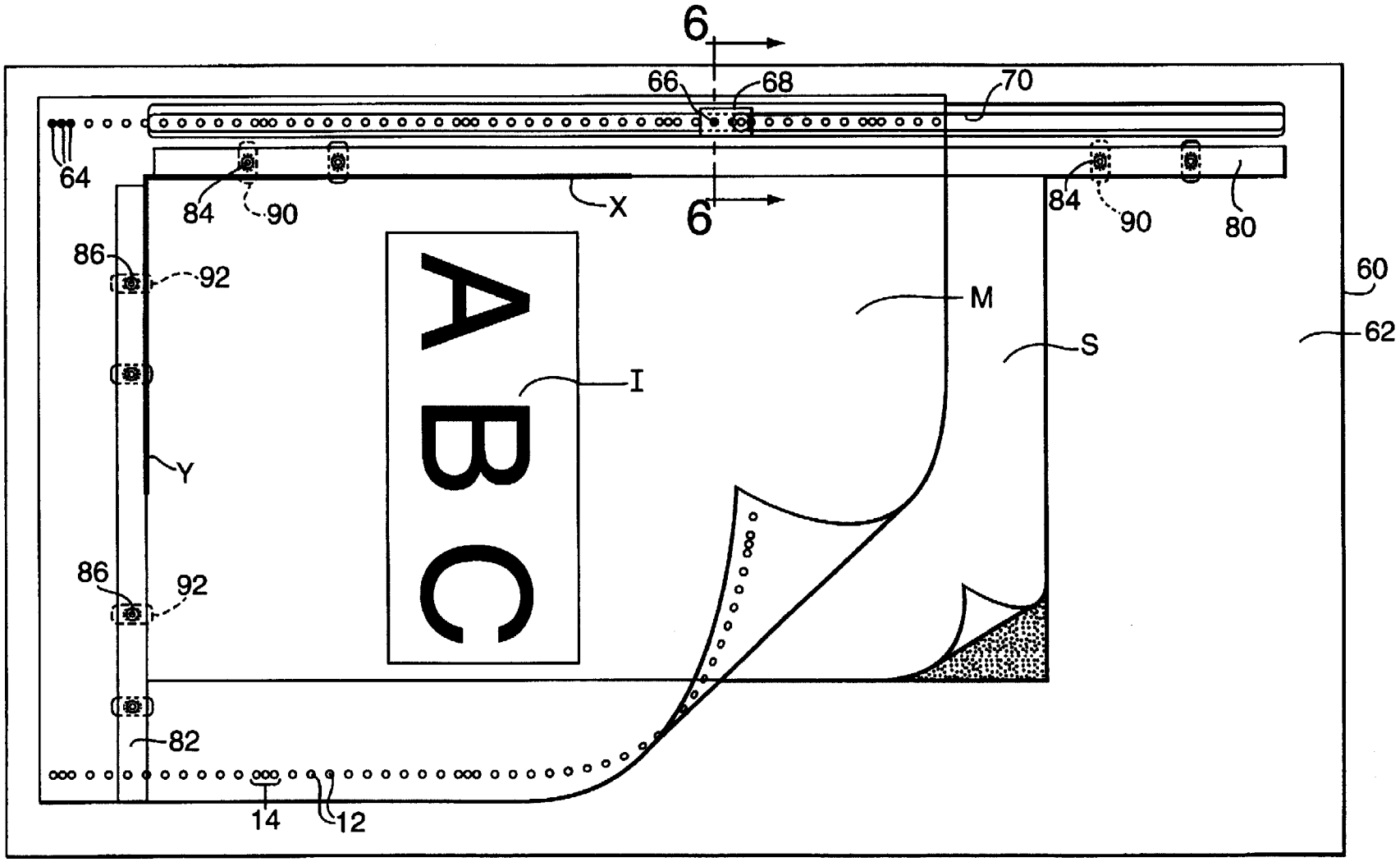
FIG. 5 is a plan view of another alignment fixture showing the method for locating the flexible sheet material in registration with plate stock.

A further embodiment of the alignment fixture is illustrated in FIGS. 5 and 6. A planar base 60, which may not comprise a worktable, defines a support surface 62 on which the flexible sheet material M and the plate stock S are mounted. As in the previous embodiment, three closely spaced pins 64 engage the corresponding set of reference holes 14 in the sheet material and a pin 66 mounted in a slide block 68 is moveable back and forth in a groove 70 in the base. The pin 66 is moveable in order to engage one of the drive holes 12 near the end of the segment of material opposite from the pins 64.

As shown in FIG. 6, the planar base 60 has a second support surface 72 on the opposite side of the base from the surface 62, and the groove 70 is a slot passing through the base from one surface to the other. Additionally, the slide block 68 extends through the groove 70 and carries a second registration pin 76 directly opposite the pin 66. Although not shown, the registration pins 64 also penetrate the base 60 and thus project through both of the support services 62 and 72. Such an embodiment is advantageous when the sheet material M must be turned over so that the side of the material on which the image is printed can be placed against the underlying plate stock S. The material can be inverted while the same set of patterned registration holes 14 in the material are used to identify the origin point of the image.

A pair of fences 80,82 are mounted on the base 60 by screws 84,86 respectively. The screws pass into clamp blocks(not shown) in elongated apertures 90,92 so that the inwardly facing edges of the fences can be adjusted in orthogonal relationship with each other and can be placed in registration with the X and Y axes printed on the sheet material M along with the image I. Each fence may be a relatively thin strip of rigid metal or plastic with an inwardly facing edge that serves as an abutment for the plate stock S on the support surface 62 of the planar base 60.

Accordingly in order to align the sheet material M with the image I in proper registration with respect to the edges of a rectangular piece of plate stock S, the material is mounted on the registration pins 64 and 66, and the positions of the fences 80 and 82 are adjusted so that the inner edges are in perfect alignment with the X and Y axes printed on the sheet material. When the fences are properly located, the plate stock is inserted in underlying relationship with the sheet material, the protective film covering the adhesive on the stock is removed, and the sheet material, while still engaged with the registration pins is pressed onto the adhesive to form the laminated product. The product may then be taken to any cutting machine and the edges of the plate stock may be used to identify the origin of the image for appropriately cutting or dividing the stock into multiple pieces, if desired.

In keeping with the reversible design of the fixture, a corresponding set of fences(not shown) are mounted on the opposite side of the base against the worksurface 72.

Figure 7:
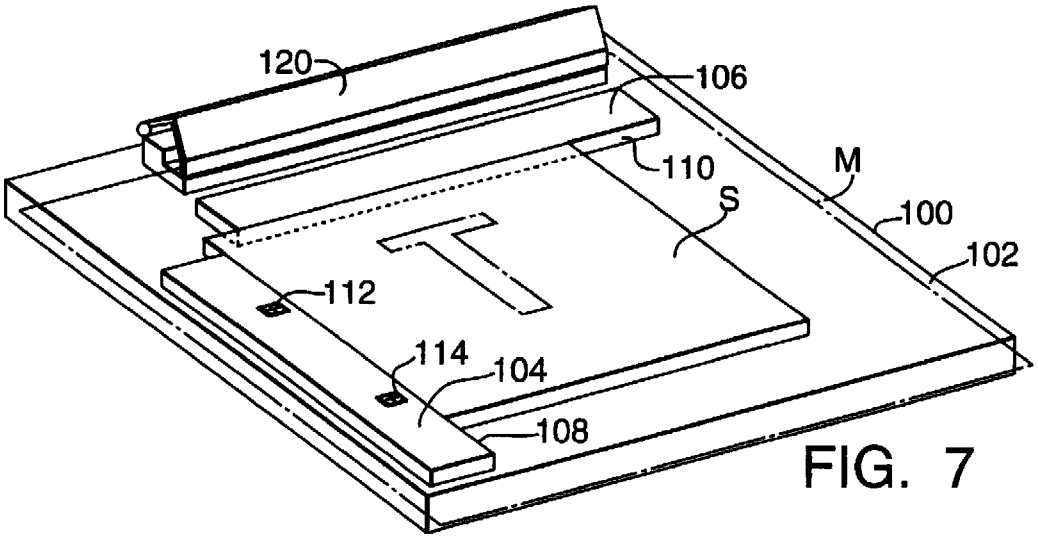
FIG. 7 is a perspective view showing another embodiment of the alignment fixture of the present invention.

FIG. 7 discloses still a further embodiment of the alignment fixture which does not rely upon any drive holes in the flexible sheet material M. The fixture includes a planar base 100 having a support surface 102 for holding plate stock and an overlying segment of sheet material M. Two fences 104 and 106 are mounted on the support surface with the inwardly facing edges 108, 110 in orthogonal relationship. A piece of planar stock S with rectangularly cut edges is then positioned in abutment with the edges. The fences can be permanently affixed to the planar base and need not be adjustable as in the embodiment of the FIG. 5.

A pair of alignment indicia 112 and 114 are printed or otherwise placed on the fence 104 at predetermined positions with respect to the abutment edges of each fence.

In order to position the image printed on the flexible sheet material M in registration with plate stock S, a set of registration indicia corresponding to the indicia 112, 114 on the fence 104 is printed on the sheet material along with the image. The printed registration indicia are located in a predetermined position relative to the rest of the printed image based upon the offset of the indicia 112, 114 from the abutment edges of the fences. Therefore the printed image on the material will fall into registration with the plate stock when the sheet material is positioned in overlying relationship with the stock and the printed registration indicia on the material are brought into registration with the alignment indicia 112, 114 on the fence. To hold the material in registration once the proper position is established, an edge clamp 120 is mounted on the planar base at one side. The sheet material is then secured by a pressure sensitive adhesive on the plate stock as described in connection with FIGS. 2 and 5.

While the present invention has been described in several preferred embodiments, it should be understood that numerous modifications and substitutions can be made without departing from the spirit of the invention. For example, the method is not limited to working with plate stock with rectangular edges since other shapes of stock can be placed and held in known positions on support surfaces by means of fences or other holddown means. The printing of the X and Y axes on the sheet material along with an image is not necessary after the registration pins or other indicia and fences of the alignment fixture have been located for a particular printer. The embodiments of the alignment fixture in FIGS. 5 and 7 may serve as locating fixtures on a cutting machine. Under such circumstances the plate stock S would be cut along lines that are spaced a minimal distance from the fences. The groove and sliding blocks are not essential if the sizes of the sheet materials M being cut are relatively uniform. The registration pins themselves are particularly useful for holding flexible sheet materials with punched drive holes, but printed and other forms of registration indicia such as shown in the embodiment of FIG. 7 can clearly be employed. Also, the grouped registration pins may be replaced with a single pin or an optical sight as long as other means such as an enlarged aperture or other printed indicia are available to identify the origin of the printed image. Accordingly, the present invention has been described in several preferred embodiments by way of illustration rather than limitation.

I claim:

1. An alignment method for accurately registering a flexible sheet material bearing a graphic image on a rigid plate stock comprising:

providing registration indicia on a flexible sheet material which indicia identify two orthogonal reference axes and an origin point for each axis;

providing a printer with means for printing and printing on the flexible sheet material a graphic image in predetermined relationship with the registration indicia;

providing an alignment fixture with registration guides which identify two orthogonal axes and an origin point for each axis for mating with the registration indicia of the flexible sheet material, and positioning the sheet material on the fixture with the orthogonal axes and origin points of the registration indicia and the guides of the fixture in predetermined relationship; and placing a rigid plate stock on the alignment fixture with the edges of the plate stock in positional relationship with the registration guides whereby the rigid plate stock and the sheet material are in a known positional relationship with each other.

2. An alignment method as defined in claim 1 wherein:

the step of providing registration indicia includes printing the indicia on the flexible sheet material by means of the printer in conjunction with the step of printing the graphic image on the material.

3. An alignment method as defined in claim 1 wherein:

the step of providing registration indicia includes placing holes in the flexible sheet material; and the step of printing on the flexible sheet material includes engaging pins in the printer with the holes in the flexible sheet material.

4. An alignment method as defined in claim 3 wherein:

the holes provided in the flexible sheet material are drive holes; and the step of printing includes engaging drive pins of the printer in the drive holes of the flexible sheet material in order to drive the material through the printer during printing.

5. An alignment method as defined in claim 4 wherein the drive holes in the flexible sheet material include a select pattern of holes identifying the origin point for each axis.

6. An alignment method as defined in claim 5 wherein:

the registration guides for positioning the flexible sheet material on the alignment fixture include a set of pins engaging the select pattern of holes in the flexible sheet material.

7. An alignment method for accurately registering a flexible sheet material on a rigid plate stock as defined in claim 1 wherein:

the alignment fixture includes at least one fence located on the fixture in predetermined alignment with one of the orthogonal axis and one of the origin points; and the step of placing the rigid plate stock on the alignment fixture includes placing an edge of the stock in abutting relationship with the fence.

8. An alignment method as defined in claim 7 wherein the location of the fence on the alignment fixture is adjustable.

9. An alignment method as defined in claim 7 wherein the fence is one of two fences located on the fixture in orthogonal relationship with each other.

10. An alignment method as defined in claim 7 wherein the registration guides of the alignment fixture are located on the fence.

11. An alignment method as defined in claim 1 further including the step of securing the flexible sheet material to the rigid plate stock on the alignment fixture whereby the graphic image printed on the flexible material by the printer and the rigid plate stock are in known registration.

12. An alignment method as defined in claim 11 wherein:

the plate stock has an adhesive coating on one side of the plate and a strippable protective sheet on the adhesive;

the step of placing the rigid plate stock on the alignment fixture includes placing the side of the plate stock bearing the adhesive and strippable protective sheet in facing relation with the flexible sheet material when the sheet material is positioned on the alignment fixture; and an additional step includes stripping the protective sheet from the plate stock to expose the adhesive after the step of placing and before the step of securing.

13. An alignment method for accurately registering a flexible sheet material on a rigid plate stock as defined in claim 1 wherein the alignment fixture includes the worktable of a cutting machine for cutting the plate stock.

14. An alignment method as defined in claim 13 wherein the registration guides include a set of pins on a bar secured to the worktable, one of the pins being slidable along the bar relative to another of the pins.

15. An alignment fixture for accurately positioning sheet material bearing an image in registration with a plate stock comprising:

a planar base defining a support surface;

registration and holding means connected to the planar base for holding sheet material in a predetermined position relative to the support surface of the base; and fence means connected to the planar base for positioning plate stock in a predetermined position on the support surface of the base and in underlying relationship with the sheet material bearing the image, whereby the fence means and the registration and holding means are connected to the base so as to position the sheet material and plate stock in a predetermined position with one another.

16. An alignment fixture as defined in claim 15 wherein:

the registration and holding means is a set of pins mounted to the planar base for engaging corresponding holes in the sheet material.

17. An alignment fixture as defined in claim 16 wherein the set of pins includes one group of pins having a arrangement differing from the other pins of the set to identify an origin point for the image on the sheet material relative to the planar base and the fence means.

18. An alignment fixture as defined in claim 16 wherein one of the pins of the set is movable on the planar base relative to the other of the pins.

19. An alignment fixture as defined in claim 15 wherein:

the registration and holding means includes clamping means connected with the planar base and indicia attached to the base for registration with other indicia on the sheet material.

20. An alignment fixture as defined in claim 19 wherein the indicia on the planar base are placed on the fence means connected to the planar base.

21. An alignment fixture as defined in claim 15 wherein the fence means includes two orthogonally disposed abutments on the support surface of the planar base.

22. An alignment fixture as defined in claim 21 wherein the registration and holding means includes indicia located in fixed relationship with the abutments.

23. An alignment fixture as defined in claim 22 wherein:

the abutments of the fence means are formed by two elongated members attached to the support surface of the planar base; and the indicia of the registration and holding means are located on one of the members.

24. An alignment fixture for accurately positioning sheet material comprising:

a planar base having a support surface for the sheet material and a groove extending along a straight line in the surface;

a first registration guide located in the base in stationary relationship with the groove for engagement with sheet material; and a second registration guide slidably mounted in the groove for movement in the groove relative to the first registration guide for engagement with the sheet material.

25. An alignment fixture as defined in claim 24 wherein each of the first and second registration guides includes pins for engaging matching holes in the sheet material.

26. An alignment fixture as defined in claim 25 wherein:

the groove has a T-shaped, cross section below the support surface of the planar base; and the second registration guide has a T-shaped body matching the cross section of the groove, the body being flush with the support surface and the pin projects from the body above the support surface.

27. An alignment fixture as defined in claim 25 wherein:

the planar base has two oppositely disposed support surfaces; the groove of the second registration guide is a slot passing through the base from one surface to the opposite surface; and the pins of the first and second registration guides extend through the planar base and project above both of the surfaces.

28. An alignment fixture as defined in claim 24 further including two fences arranged in orthogonal relationship on the support surface of the base to position plate stock on the surface underneath the sheet material engaged by the first and second registration guides.

* * * * *